US006418766B1

(12) United States Patent
Luebeck

(10) Patent No.: US 6,418,766 B1
(45) Date of Patent: Jul. 16, 2002

(54) KEY CONTAINER WITH IMPROVED LOCKING FEATURES

(75) Inventor: Jon Marc Luebeck, Stayton, OR (US)

(73) Assignee: Interlogix, Inc., Salem, OR (US)

( * ) Notice: Subject to any disclaimer, the term of this patent is extended or adjusted under 35 U.S.C. 154(b) by 0 days.

(21) Appl. No.: 09/545,277

(22) Filed: Apr. 7, 2000

(51) Int. Cl.[7] ..... E05B 9/04
(52) U.S. Cl. ..... 70/371; 70/368
(58) Field of Search ..... 70/371, 367, 368, 70/370, 448, 449, 451

(56) References Cited

U.S. PATENT DOCUMENTS

| | | | | |
|---|---|---|---|---|
| 3,436,937 A | | 4/1969 | Barrett | 70/63 |
| 3,742,741 A | | 7/1973 | Cahan | 70/63 |
| 4,099,397 A | * | 7/1978 | Dauenbaugh | 70/371 |
| 4,325,239 A | | 4/1982 | Larson | 70/139 |
| 4,463,584 A | | 8/1984 | De Forrest | 70/63 |
| 5,060,491 A | | 10/1991 | Smith | 70/63 |

* cited by examiner

*Primary Examiner*—Yonel Beaulieu
(74) *Attorney, Agent, or Firm*—Klarquist Sparkman, LLP

(57) ABSTRACT

A key container has a body with a chamber, an access opening that communicates with the chamber and a cover that can be locked in place over the opening. A key-operated locking assembly is attached to the cover and engagable with the body to lock the cover in place. The cover can be engaged with the body and locked in place without operating the key.

14 Claims, 6 Drawing Sheets

72
22
44
24b
42
32,34c
62
90
64
92
46
47
45
78
43
36
82
100
48
96
94
88
20
80
30
84
41
74
25
76
50
17
24a
78
24c
16
14
12

KEY CONTAINER WITH IMPROVED LOCKING FEATURES

BACKGROUND

This invention relates to key containers, and in particular, to improvements in the operation and installation of key container lock assemblies.

Key containers are known. In general, a key container is a box-like structure positioned at a desired location for allowing authorized users to access keys or other items stored within a locked chamber inside the structure. A typical key container may have a locking front cover connected to a rear portion, with the chamber being accessed by using a key to unlock the cover and thus gain access to the key stored in the chamber.

Key containers are used in a variety of applications. Motor vehicle dealers and valets often use key containers that are attached to vehicles, e.g., by a hanger that suspends the key container over a window of the vehicle (thus preventing easy theft of the key container). In other applications, key containers are mounted on or near buildings or on motor vehicles in a more permanent fashion, e.g., with fasteners.

In typical key containers having a key locking mechanism, the key container must be disassembled to change the locking mechanism. Typically, such disassembly requires tools. A key container owner may wish to change the lock assembly if it becomes damaged or worn, or if the owner wishes to have several such key containers keyed in a particular manner, e.g., such that one key will open a number of key containers.

Also, the locking assembly typically has a rotating locking member that must be rotated to unlock the key container (allowing it to be opened) and then again in the opposite direction to relock the key container (after it has been closed). Thus, the user must operate the key in both the unlocking and locking operations, which can be inconvenient.

It would be advantageous to provide a key box having a lock assembly that could be easily interchanged and easy to operate.

SUMMARY

According to the invention, a key container having a lock assembly for securing a cover in place to restrict access to a chamber is removably coupled to the cover. Thus, the lock assembly may be changed or replaced easily. The lock assembly may be removable from the cover when the key container is open. The lock assembly may be slidably removable from a bore in the cover. The lock assembly may form a snap-fit connection with the cover. The lock assembly may be removable from the cover without requiring the use of tools.

The lock assembly may be configured to "snap shut," i.e., to lock the cover in a closed position simply by closing the cover (without requiring the use of a key). The lock assembly may have a spring biased bolt that is normally extended, but retracts and then extends again to engage the lock with the body such that the key container is in a locked state.

DETAILED DESCRIPTION

Figure 1:
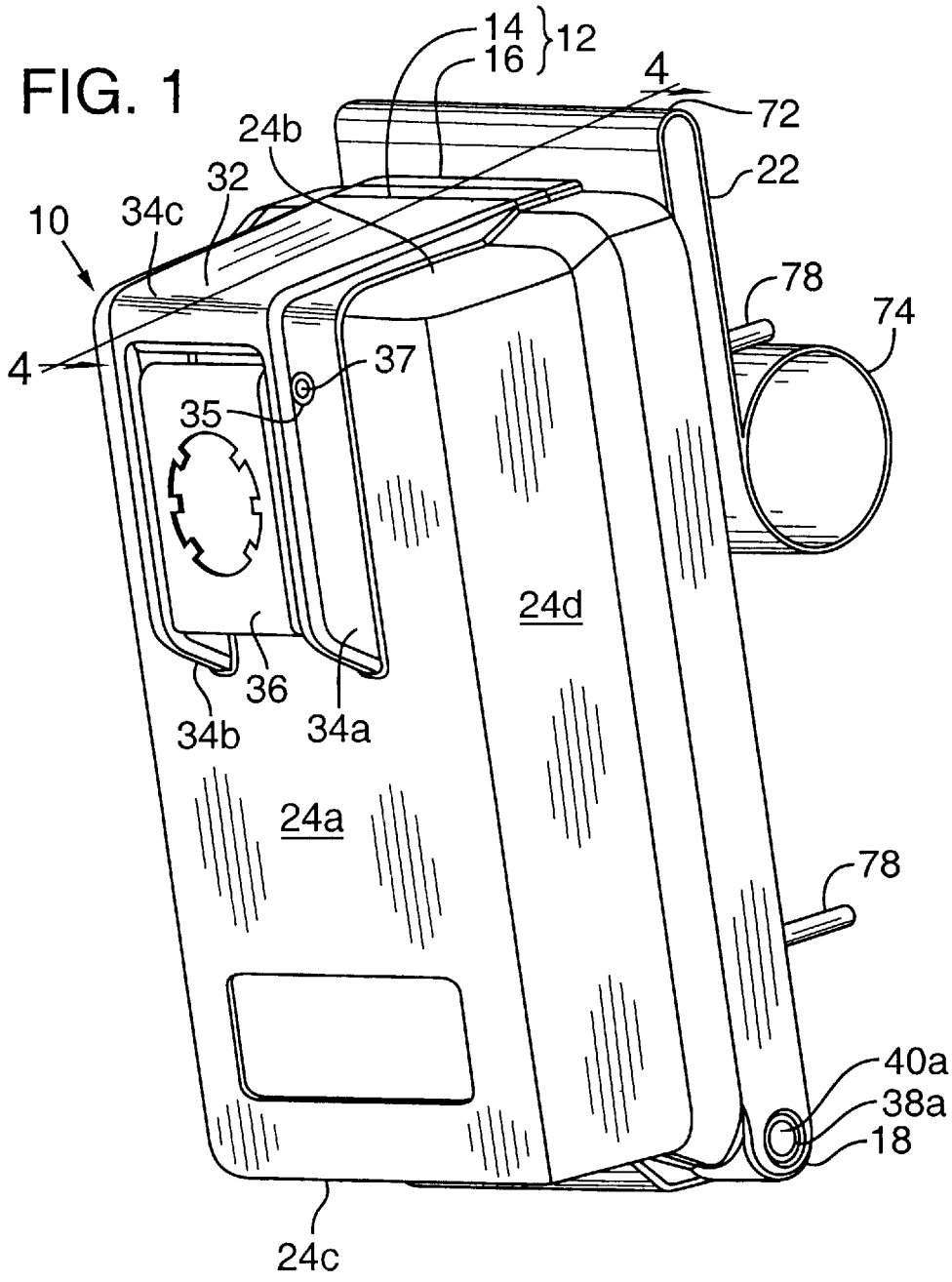
FIG. 1 is a front perspective view of a key container according to the invention with an attached hanger for use in securing the key container over a window of a vehicle.

According to one aspect of the invention, a locking assembly used with the key container is removably coupleable to a portion of the key container such that when the key container is opened, the lock assembly can be easily removed (e.g., for replacement or substitution). According to another aspect of the invention, a key-actuated lock assembly is configured such that the key need not be operated when the key container is reconfigured from an opened position to a closed and locked position.

An embodiment of a key container 10 according to the invention is shown in FIGS. 1–6. The key container 10 has a body 12 with a general form of a rectangular solid when the key container 10 is in a closed position. A chamber 17 for storing keys or other items is defined within the body 17. In the implementation shown in FIGS. 1, 3 and 4, the body 12 has front and rear portions 14 and 16, respectively, shaped to fit together along their outer edges. Together, the inner surfaces of the front portion 14 and the rear portion 16 define a chamber 17 for storage of keys or other items (not shown).

Figure 5:
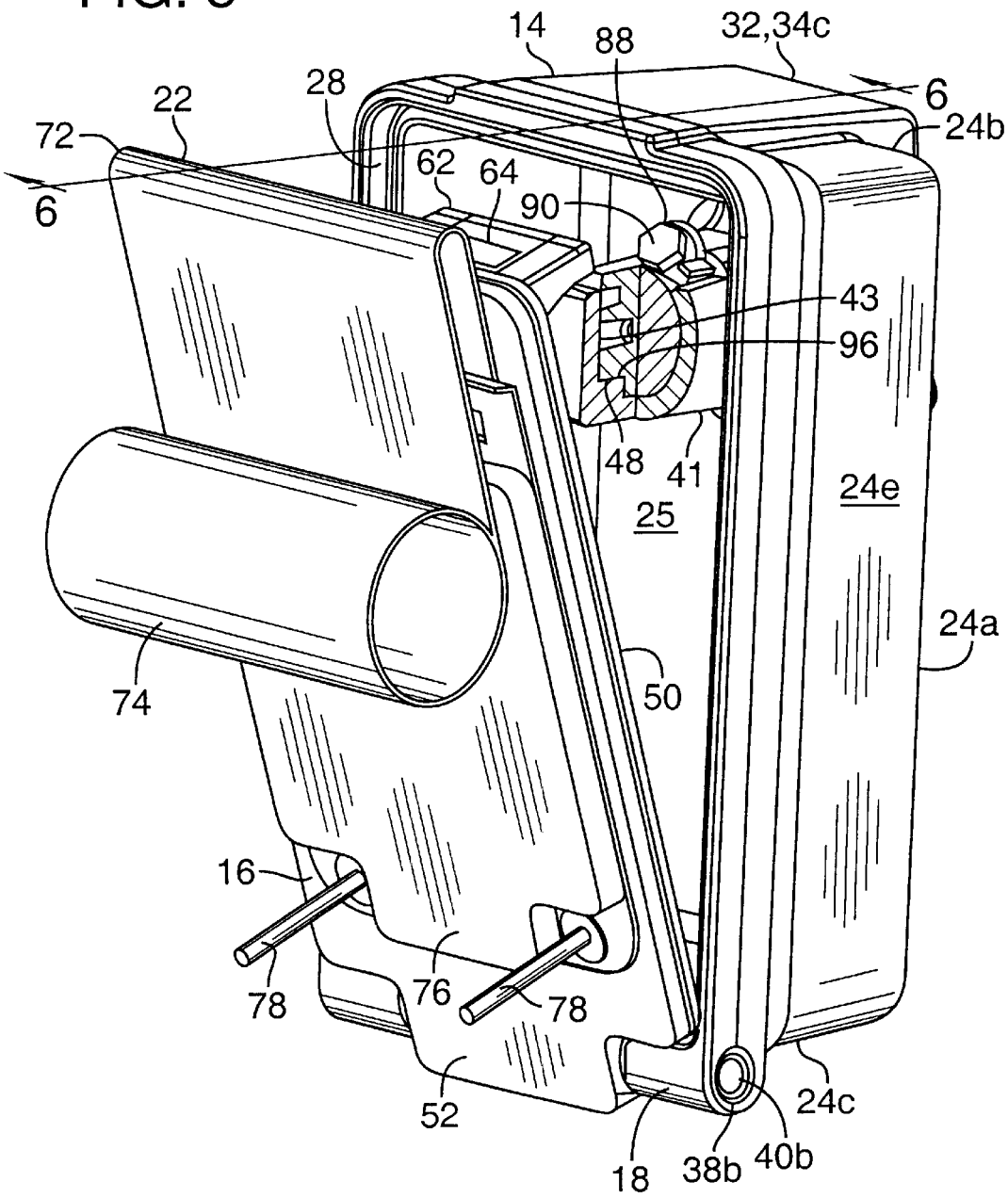
FIG. 5 is a rear perspective view similar to FIG. 3, except with the key container in a partially opened position, and the lock assembly and lock receiving bore shown partially in section to show the respective mating features.
Figure 6:
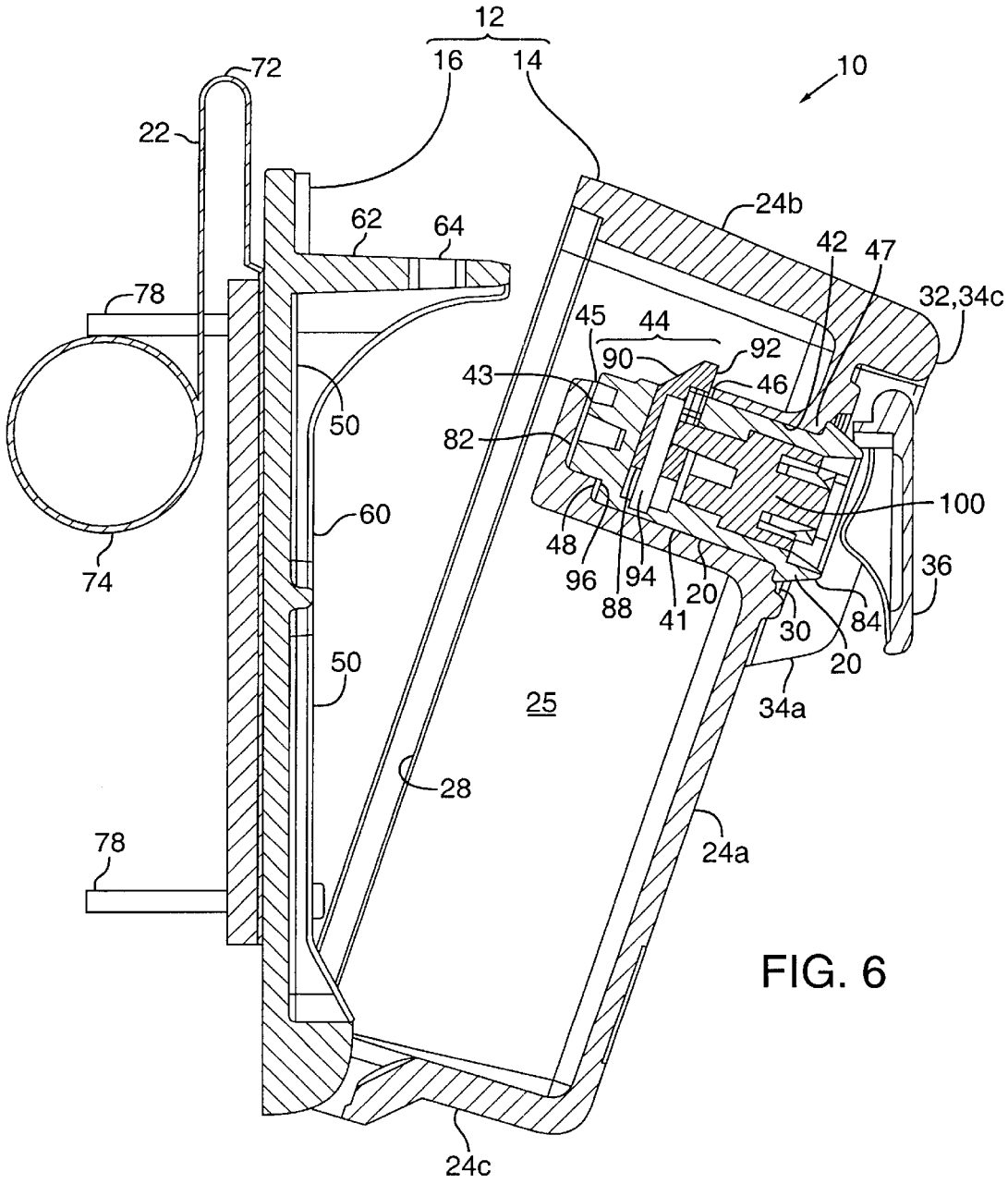
FIG. 6 is a right side sectional view of the key container of FIG. 5 taken along the line VI—VI in FIG. 5.

To position the key container 10 in an opened position and access the chamber 17, e.g., as shown in FIGS. 5 and 6, a cover is moved to expose an access opening. In the illustrated implementation, the "cover" is the front portion 14, which may be pivoted relative to the rear portion 16 about a hinge 18 as shown to expose the chamber 17.

The front portion 14 can be locked to the rear portion 16 with a lock assembly 20. In the illustrated implementation, the lock assembly 20 is actuated using a corresponding key (not shown) of any suitable type. The lock assembly 20 is coupled to the front portion 14 and positioned to engage the body 12, e.g., the rear portion 16, when the key container 10 is in the closed position. To open the key container 10, the lock assembly 20 is unlocked. Further details of the construction and operation of the lock assembly 20 are described below.

As illustrated in the figures, the key container 10 can be used with a hanger 22 that allows the key container to be suspended, e.g., over the edge of a window of a motor vehicle (not shown). The window is first partially opened, a lip 72 of the hanger 22 is positioned over a top edge of the opened window, and the window is then raised to secure the hanger 22 between the window and its frame, therefore reducing the chance of a simple theft of the key container 10. An end 74, which may be tubular as shown, is thus positioned adjacent an interior side of the raised window. An elastomeric bumper 76 (FIG. 2) can be attached (preferably by an adhesive 77) to the hanger 22 to prevent damage to the window. Alternatively, the key container 10 can be used without the hanger 22, e.g., if the key container is to be secured in place to a building or a vehicle with fasteners.

Figure 4:
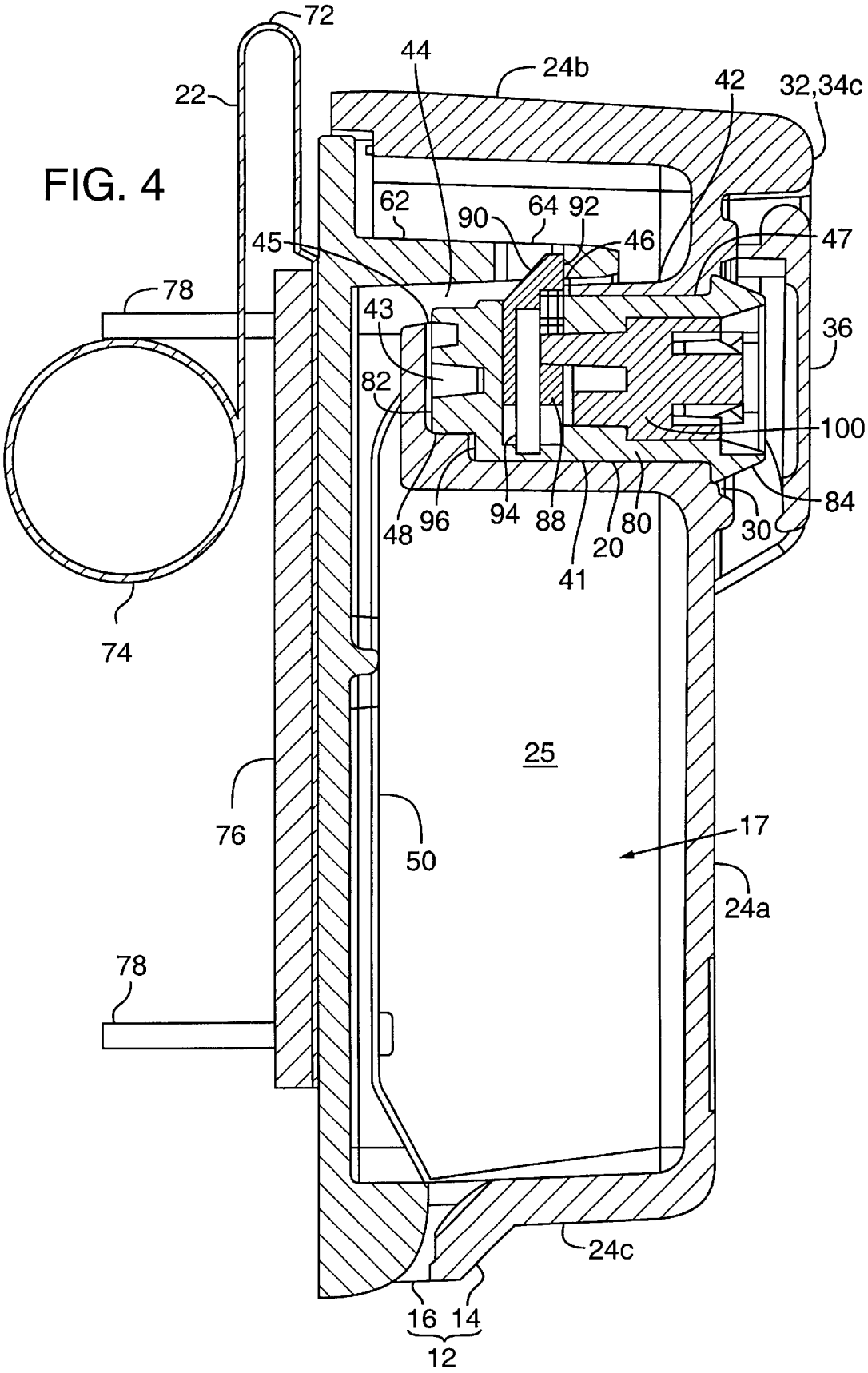
FIG. 4 is a right side sectional view of the key container of FIG. 1 taken along the line IV—IV in FIG. 1.

As shown, e.g., in FIG. 1, the front portion 14 has a front side 24*a*, top and bottom sides 24*b*, 24*c*, and right and left sides 24*d*, 24*e*, respectively. Inner surfaces of the sides 24*a*–24*e* define a recess 25 in the front portion. In the illustrated implementation, as shown in FIG. 4, the chamber 17 is defined by the recess 25 in the front portion, together with a front surface 50 of the rear portion 16.

As best shown in FIG. 5, the front portion 16 includes a peripheral lip 28 shaped to contact a gasket 66 (FIG. 2) that seals the interface between the front portion 14 and the rear portion 16 when the key container 10 is closed. The gasket 66, which is preferably formed of an elastomeric material and attached to the rear portion 16 by adhesive, is designed to prevent moisture and dust from entering the chamber 17. The gasket 66 may be formed with apertures 68 that provide clearance for fasteners (e.g., rivets 78).

Figure 2:
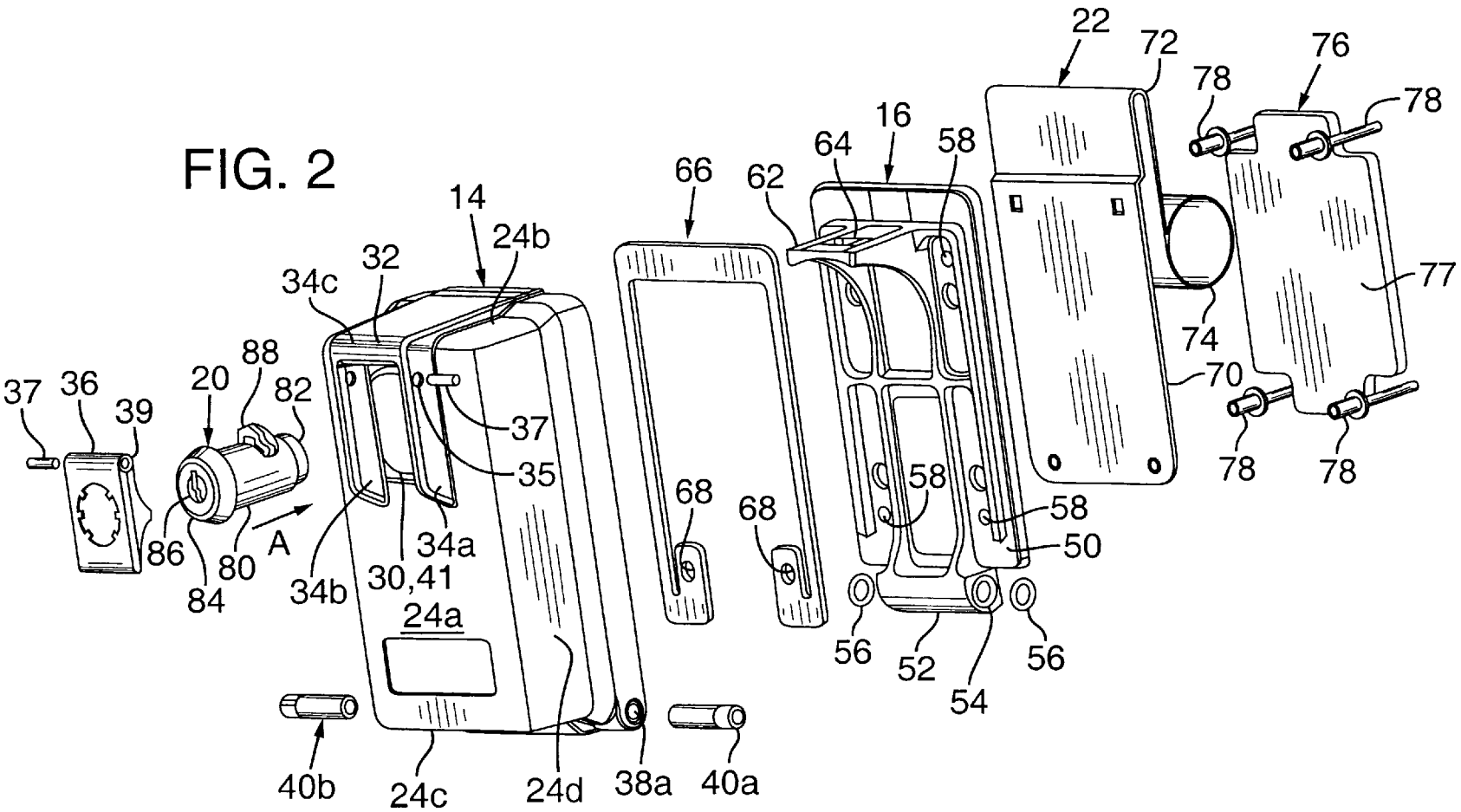
FIG. 2 is an exploded view of the key container of FIG. 1.
Figure 3:
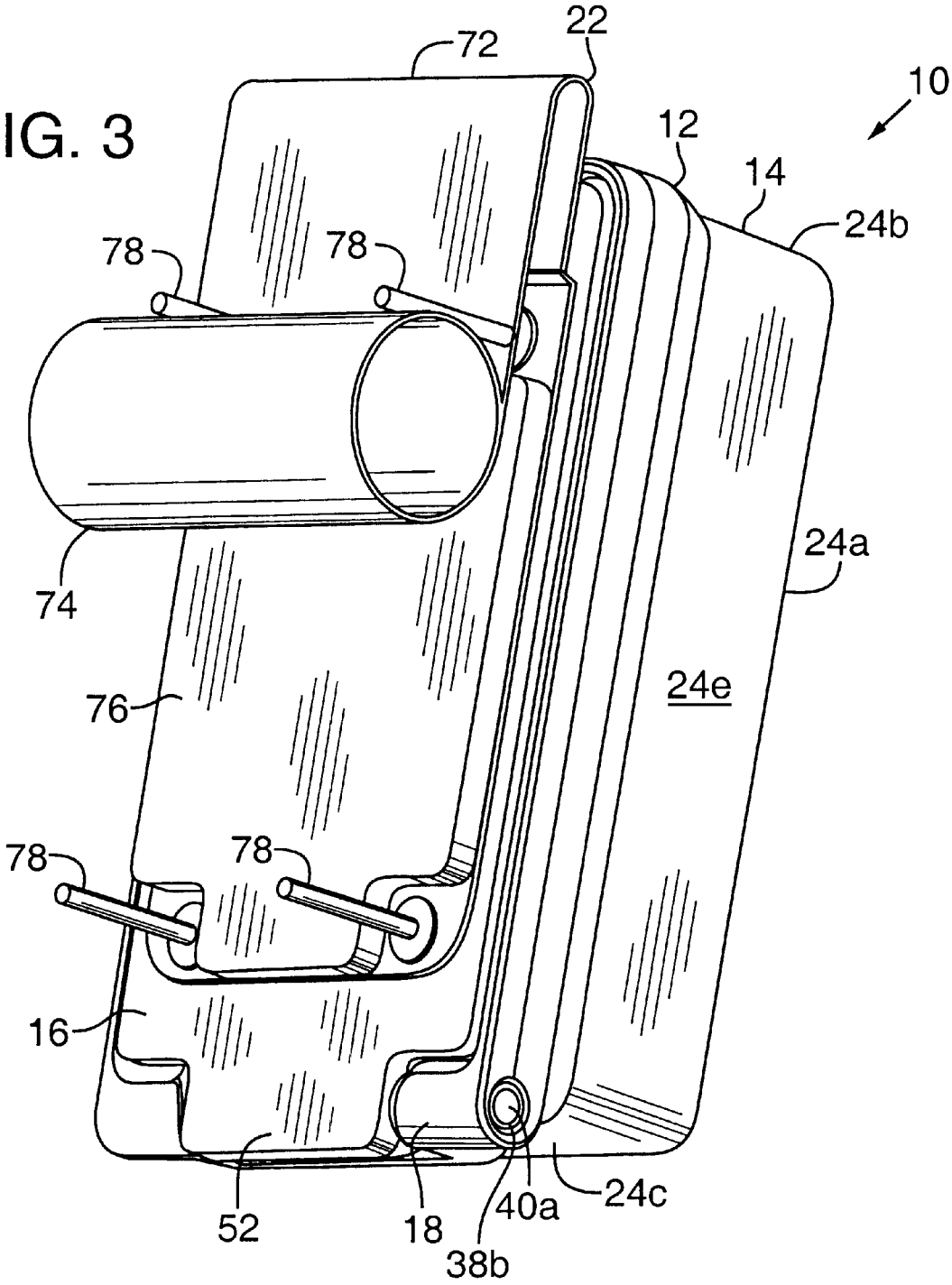
FIG. 3 is a rear perspective view of the key container of FIG. 1.

As best shown in FIG. 2, the front side 24*a* has a lock assembly bore 41 extending inwardly from a lock assembly opening 30 formed in the front side 24*a*. In one implementation, the lock assembly 20 is removably coupled to the front portion 14. For example, as shown in FIGS. 2, 4 and 6, the lock assembly bore 41 can be dimensioned to slidingly receive the lock assembly 20.

The lock assembly opening 30 is covered by a cover member 36. The front side 24*a* has a projecting cover frame 32 formed from right, left and top ribs 34*a*, 34*b* and 34*c*, respectively. Holes 35 in the right and left ribs 34*a* and 34*b* receive pins 37 that extend through a bore 39 in the cover member 36 to pivotably connect the cover member 36 to the cover frame 32.

Adjacent the bottom side 24*c*, the front portion 14 has a left and right bores 38*a*, 38*b* dimensioned to receive corresponding pins 40*a*, 40*b*, respectively. The pins 40*a*, 40*b* extend into a bore 54 (FIG. 2) formed in the rear portion 16, thereby forming the hinge 18. Optionally, O-rings 56 may be provided on the pins 40*a*, 40*b* adjacent either side of the bore 54 (FIG. 2).

The rear portion 16 has a web of supporting ribs 60 extending from the front surface 50. A catch 62 with a bolt receiving slot 64 extends from the front surface 50. Apertures 58 are formed in the rear portion 16. The apertures 58 can receive the rivets 78 to connect the hanger 22 to the key container or fasteners (not shown) for attaching the key container 10 to an object when the hanger 22 is not used. In the figures, the rivets 78 are shown in their full-length state following assembly and prior to being trimmed to an appropriate length (e.g., flush with a rear surface 70 of the hanger 22).

Following are further details regarding installation and operation of the lock assembly 20. As described above, the lock assembly is removably coupled to the cover, and, in a specific implementation, the lock assembly 20 is slidingly received in the lock assembly bore 41 of the front portion 14. As an additional feature, the lock assembly 20 may be configured to allow its removal without the use of tools.

As shown in FIG. 4, the lock assembly 20 has a generally cylindrical body 80 that defines an axial direction, a forward end 82 and a flanged rearward end 84 with an access feature 86 (e.g., a key hole shaped to receive a corresponding key as shown in FIG. 2). In the illustrated implementation, the lock assembly 20 also has a movable locking member or bolt 88 positioned to extend radially from the surface of the body 80 at a point between the forward end 82 and the rearward end 84. The bolt 88 has an angled forward side 90 and a flat rearward side 92. The bolt 88 is normally biased in a direction away from the body 80 by a spring 94. As shown in FIGS. 4, 5 and 6, the forward end 82 has an alignment feature, e.g., a notch 96, that mates with a corresponding alignment feature formed in the lock assembly bore 41.

The lock assembly bore 41 has a cylindrical wall 42 joined to an end surface 43. As illustrated in FIG. 4, a bolt receiving opening 44 in the bore 41 is defined by an upper edge 45 of the end surface 43 and a circumferential edge 46 of an upper side 47 of the cylindrical wall 42. The lock assembly bore 41 also includes the corresponding mating feature, e.g., a step 48, to engage the notch 96 of the lock assembly 20.

The lock assembly 20 is assembled in the key container 10 by aligning the forward end 82 with the opening 30, and pushing the rearward end 84 in the direction A (FIG. 2) to slide the lock assembly 20 into the lock assembly bore 41. As the lock assembly is urged in the direction A, the angled forward side 90 of the bolt 88 allows the lock assembly 20 to continue sliding within the lock assembly bore 41, with the upper side 47 urging the bolt 88 toward the body 80 against the action of the spring 94. As the flat side 92 of the bolt 88 is slid past the circumferential edge 46, and thus the bolt 88 becomes aligned with the bolt receiving opening 44, the bolt 88 returns to its normal position away from the body 80 under the action of the spring 94. Also, the forward end 82 of the lock assembly 20 is positioned adjacent the end surface 43 of the lock assembly bore 41. The engagement between the spring-biased bolt 88 and the bolt receiving opening 44 thus creates a "snap-fit" connection between the locking assembly 20 and the body 12 of the key container 10.

As shown in FIG. 4, the flat side 92 of the bolt 88 engages the bolt receiving slot 64 in the catch 62 to lock the front portion 14 and the rear portion 16 together. In the locked state, this engagement prevents the front portion 14 from being pivoted away from the rear portion 16. In normal use, the key container 10 is opened by unlocking it, e.g., by inserting a key in the access feature 86 and rotating it counterclockwise. During such an unlocking operation, the key causes a lock cylinder 100 coupled to the bolt 88 to rotate, thereby retracting the bolt 88 and disengaging it from the bolt receiving slot 64 to allow the front portion 14 to be pivoted away from the rear portion 16 and to provide an access opening to the compartment 17. Rotation of the lock assembly 20 relative to the lock assembly bore 41 is prevented by the engagement between the notch 96 and the step 48.

With the key container 10 in the opened state, e.g., as shown in FIG. 5, the lock assembly 20 can be removed. To remove the lock assembly 20, the bolt 88 is depressed (e.g., using one's finger) to retract the bolt toward the body 80 until the bolt 88 clears the circumferential edge 46 of the locking assembly bore 41. The lock assembly 20 is then slid out of the lock assembly bore 41 by pushing the forward end 82. Thus, the lock assembly 20 is easily removed for replacement or exchange without the use of tools by simply opening the key container 10 in an authorized manner (i.e., with a key) and performing a simple operation. When the lock assembly is being unlocked with a key, the cylinder 100 is configured to retract the bolt 88 only to the extent necessary to clear the bolt receiving slot, and not the additional distance required to clear the circumferential edge 46, which prevents the lock assembly 20 from being inadvertently removed.

As a further feature, the engagement between the spring-biased bolt 88 and the catch 62/bolt receiving slot 64 is such that the lock assembly 20 need not be actuated to return the front portion 14 from an opened state (FIG. 6) to a closed and locked state (FIG. 4). In other words, once the key container 10 is opened, it may be closed and locked simply by pivoting the front portion 14 into the closed position against the rear portion 16, with the bolt 88 being momentarily retracted by engagement with the catch 62 until the bolt 88 becomes aligned with the bolt receiving slot 64 and extends to its normal outwardly biased position, thus locking the key container 10. Stated differently, the key container 10 is simply "snapped shut" to return it from a opened state to a closed state. Thus, the key to the key container 10 is only required to unlock the key container 10, not to relock it. This feature saves considerable time for individuals, e.g., parking attendants and valets, who must repeatedly access a number of key containers.

The front portion 14 and the rear portion 16 are preferably formed of a cast material and provided with a suitable finish for weather resistance. In a particular embodiment, the body 12 of the key container 10 has a height of approximately 5 inches, a width of approximately 3.5 inches and a depth of approximately 2 inches.

Having illustrated and described the principles of my invention with reference to several preferred embodiments, it should be apparent to those of ordinary skill in the art that the invention may be modified in arrangement and detail without departing from such principles. We claim all such modifications which fall within the scope and spirit of the following claims.

What is claimed is:

1. A locking key container, comprising:

a body having an access opening and a chamber within the body in communication with the access opening;

a cover engagable with the body to cover the access opening; and a lock assembly removably coupled to the cover by a snap-fit connection and engagable with the body to lock the cover to the body.

2. The key container of claim 1, wherein the cover includes a bore dimensioned to receive the lock assembly and defining an axial direction, and wherein the lock assembly is slidingly removable from the bore in the axial direction.

3. The key container of claim 2, wherein the bore comprises a cylindrical side surface joined to an end surface and an opening formed in the cylindrical side surface, and wherein the lock assembly includes a retractable locking member engagable with the opening when the lock assembly is received in the bore.

4. The key container of claim 3, wherein the locking member is retractable in a radial direction to disengage the locking member from the opening and to allow the lock assembly to be slidingly removed from the bore.

5. The key container of claim 3, wherein the end surface of the bore comprises a step extending in the axial direction and the lock assembly has a forward end with a notch dimensioned to receive the step when the lock assembly is rotationally aligned within the bore.

6. The key container of claim 1, wherein the body comprises a front portion hingedly connected to a rear portion.

7. The key container of claim 6, wherein a portion of the chamber formed in the body is a recess in the rear portion, and wherein the rear portion comprises a catch with which the lock assembly can be engaged to lock the front portion and the rear portion together.

8. The key container of claim 7, wherein the catch projects outward from the rear portion and has a slot.

9. A key container, comprising:

a body having a chamber, an access opening that communicates with the chamber and a cover that can be locked in place to restrict access to the chamber;

a key-operated lock assembly attached to the cover and engagable with the body to lock the cover in place, wherein the cover can be engaged with the body and locked in place without operating a key.

10. The key container of claim 9, wherein the lock assembly comprises a biased locking member engageable with the body, and wherein the body moves the locking member opposite its biased direction when the cover is moved into place to cover the opening in the body.

11. The key container of claim 10, wherein the body includes a catch having a slot, and wherein the locking member contacts the catch and is momentarily retracted as the cover is closed.

12. In a key container having a body with a chamber, an opening that communicates with chamber, and a cover with a lock assembly engaged with and locked to the body to prevent access to the chamber, a method of removing the lock from the cover, comprising:

using a key to unlock the lock assembly;

disengaging the cover from the body to expose a body side of the cover; and manipulating the lock assembly from the body side of the cover to remove the lock assembly from the cover.

13. The method of claim 12, wherein the lock assembly includes a biased locking member engaged with the body when the cover is locked to the body, and wherein manipulating includes depressing the biased locking member.

14. The method of claim 12, further comprising removing the key from the lock assembly before removing the lock assembly from the cover.

* * * * *